US005527243A

United States Patent [19]

Chen

[11] Patent Number: 5,527,243

[45] Date of Patent: Jun. 18, 1996

[54] ADJUSTABLE HORSE-RIDING TYPE EXERCISER

[76] Inventor: Paul Chen, 5th Floor, No. 31, Gan Tzou 2nd St., Shi Tun Chu, Taichung, Taiwan

[21] Appl. No.: 529,564

[22] Filed: Sep. 18, 1995

[51] Int. Cl.[6] ..... A63B 69/06

[52] U.S. Cl. ..... 482/72; 482/96; 482/57

[58] Field of Search ..... 482/96, 72, 57, 482/95, 112, 58, 62, 73, 51, 111; 472/110, 106

[56] References Cited

U.S. PATENT DOCUMENTS

| | | | |
|---|---|---|---|
| 2,924,456 | 2/1960 | Miller | 482/142 |
| 5,039,088 | 8/1991 | Shifferw | 482/57 |
| 5,356,357 | 10/1994 | Wang et al. | 482/96 |
| 5,429,568 | 7/1995 | Chen | 482/57 |

FOREIGN PATENT DOCUMENTS 498342 5/1930 Germany .

*Primary Examiner*—Jerome Donnelly
*Attorney, Agent, or Firm*—Charles E. Baxley

[57] ABSTRACT

A horse riding type exerciser includes a base, a seat post and a foot post and a handle bar pivotally coupled to the base. The handle bar has a upper axle and a lower axle. A link has one end pivotally coupled to the lower portion of the foot post and has the other end for pivotally coupling to the upper and lower axles. The seat cushion is elevated by pulling the handle bar when the link is coupled to the upper axle. The seat cushion is elevated by pushing the handle bar when the link is coupled to the lower axle.

4 Claims, 3 Drawing Sheets

ADJUSTABLE HORSE-RIDING TYPE EXERCISER

BACKGROUND OF THE INVENTION

1. Field of the Invention

The present invention relates to an exerciser, and more particularly to a horse-riding type exerciser convertible to both pull type and push type exercises.

2. Description of the Prior Art

Various kinds of horse riding type exercisers have been developed. Four prior arts are disclosed in U.S. Pat. No. 5,342,269 to Huang et al. issued Aug. 30, 1994; U.S. Pat. No. 5,356,357 to Wang et al. issued Oct. 18, 1994; U.S. Pat. No. 5,356,358 to Chen issued Oct. 18, 1994; and U.S. Pat. No. 5,366,428 to Liao issued Nov. 22, 1994.

However, the typical horse riding type exercisers are pull type exercisers, i.e., the handle bar may be pulled for conducting horse riding type exercises. The exercisers may not be used for conducting push type exercisers.

The present invention has arisen to mitigate and/or obviate the afore-described disadvantages of the conventional horse riding type exercisers.

SUMMARY OF THE INVENTION

The primary objective of the present invention is to provide a convertible horse-riding type exerciser which can be used for conducting both pull type and push type horse riding exercises.

In accordance with one aspect of the invention, there is provided a horse riding type exerciser comprising a base including a front portion having a pivot shaft provided therein, including a middle portion having a pivot axis provided therein, and including a rear portion having a track means provided therein, a seat post including a lower portion pivotally coupled to the base at the pivot shaft, including an upper portion having a seat cushion provided thereon, and including a middle portion, a pole means including a lower portion slidably engaged in the track means and including an upper portion pivotally coupled to the middle portion of the seat post, a foot post including a middle portion pivotally coupled to the pivot shaft and including an upper portion having a foot pedal means provided thereon, the foot post including a lower portion, a handle bar means including a middle portion pivotally coupled to the base at the pivot axis and including a hand grip means provided on top thereof, the handle bar means including at least one first pivot axle arranged above the pivot axis and including at least one second pivot axle arranged below the pivot axis, a beam pivotally coupled between the upper portion of the foot post and the pole means for moving the lower portion of the pole means along the track means when the foot post is rotated about the pivot shaft, and a link means including a first end pivotally coupled to the lower portion of the foot post and including a second end for pivotally coupling to the first and the second pivot axles. The seat cushion is elevated when the pole is moved toward the foot post by the beam-and when the foot post is rotated by the handle bar means and when the second end of the link means is coupled to the first pivot axle and when the hand grip means is pulled toward the seat cushion. The seat cushion is elevated when the second end of the link means is coupled to the second pivot axle and when the hand grip is pushed away from the seat cushion.

A stick means is secured to the link means for operating the link means.

The second end of the link means includes a notch means for engaging with the first and the second pivot axles.

An actuator means is secured between the foot post and the pivot axis so as to apply a force against the foot post.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

A horse-riding type exerciser in accordance with the present invention may be used for conducting both pull type and push type horse riding exercises. A U.S. Patent application was filed on Jan. 7, 1994 with the application Ser. No. 08/272,767, now allowed as U.S. Pat. No. 5,429,568 U.S. Patent is taken as a reference. The present invention is provided to simplify the configuration and to reduce the manufacturing cost of the device of U.S. Pat. No. 5,429,568.

Figure 1:
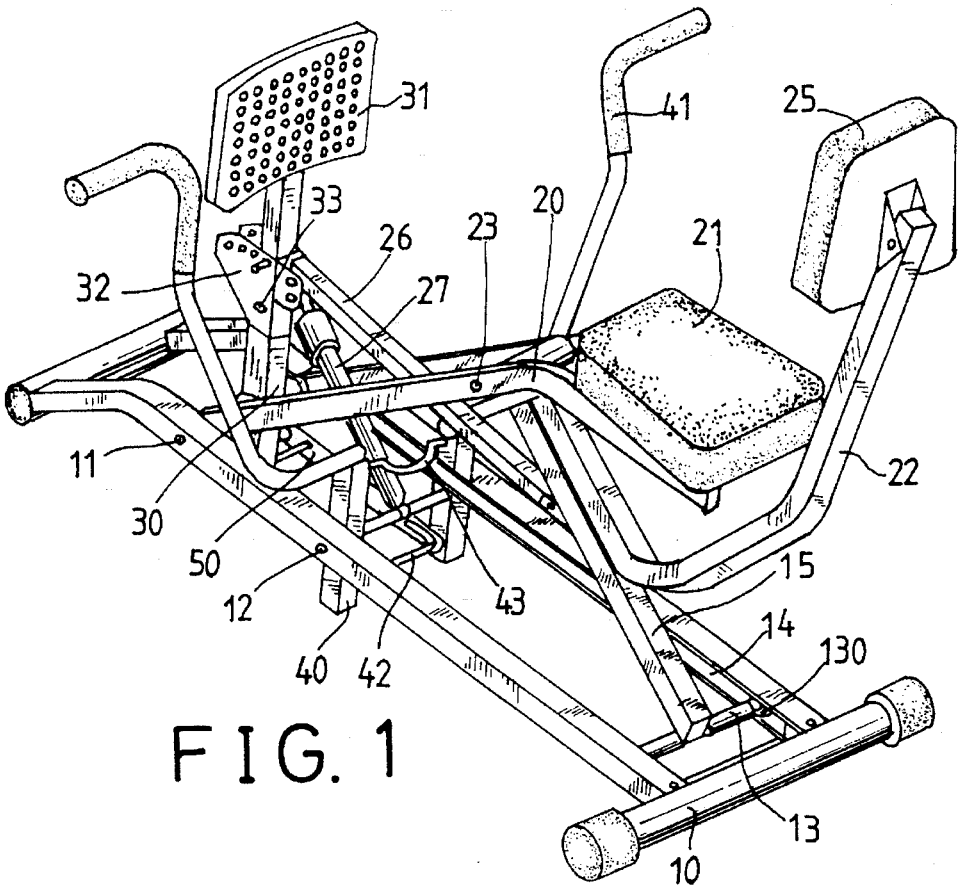
FIG. 1 is a perspective view of a horse-riding type exerciser in accordance with the present invention.
Figure 2:
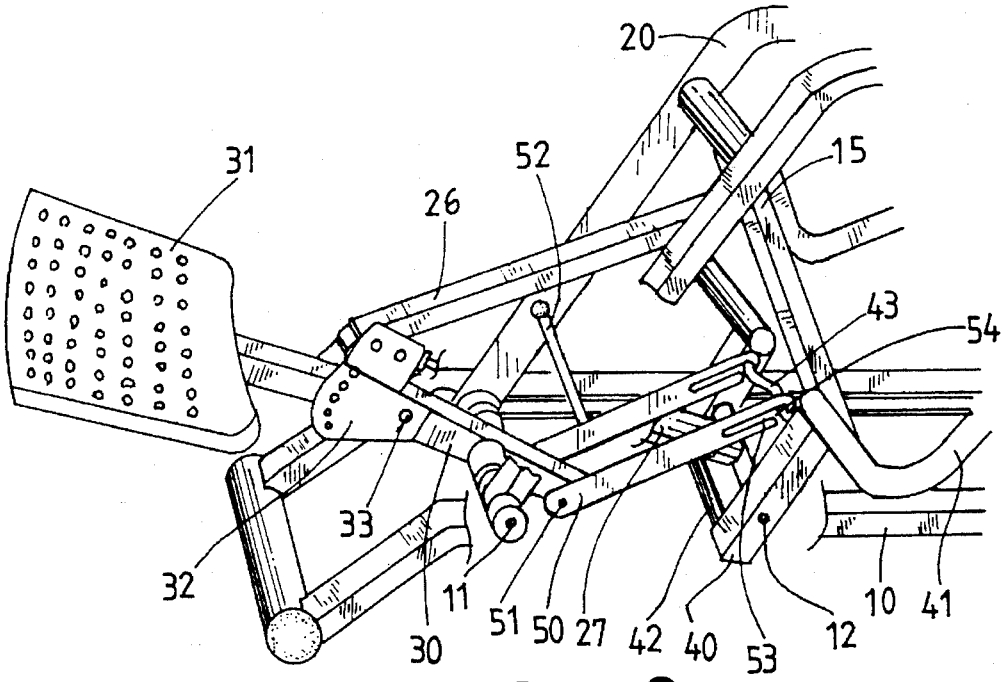
FIG. 2 is an enlarged partial perspective view of the horse-riding type exerciser.
Figure 3:
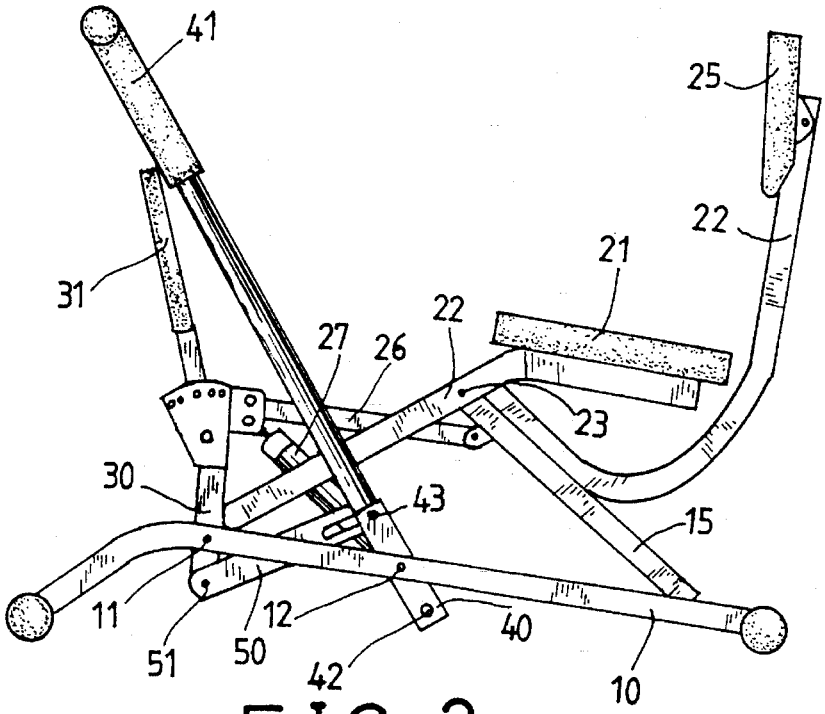

Referring to the drawings, and initially to FIGS. 1 to 3, the exerciser in accordance with the present invention comprises a base 10 including a pivot shaft 11 provided in the front portion and including a pivot axis 12 provided in the middle portion thereof. The base 10 includes a pair of tracks 14 provided in the rear portion. A pole 15 includes a lower portion secured to a rod 13 which has two rollers 130 secured to the end portions and rotatably engaged in the tracks 14 of the base 10 such that the rod 13 may move along the tracks 14. A seat post 20 includes a lower portion pivotally coupled to the base 10 at the pivot shaft 11 and includes a seat cushion 21 provided on the upper portion thereof. A back support 22 is secured on the pole 15 and includes a back cushion 25 provided on top thereof. The upper end portion of the pole 15 is pivotally coupled to the middle portion of the seat post 20 at a pivot pin 23 such that the rod 13 may be caused to move along the tracks 14 when the seat post 20 is rotated about the pivot shaft 11.

A foot post 30 includes a middle portion pivotally coupled to the pivot shaft 11 and includes a pair of panels 32 secured on top thereof. A foot pedal means 31 has a bottom portion pivotally coupled to the foot post 30 at a pivot axis 33 and may be secured to the panels 32 such that the foot pedal means 31 may be adjusted to a suitable angular position relative to the foot post 30. A beam 26 is pivotally coupled between the foot post 30 and the pole 15. An actuator 27 is pivotally coupled between the upper end of the foot post 30 and the pivot axis 12 so as to apply a resistance force to the foot post 30.

A pair of handle bars 40 include a middle portion pivotally coupled to the pivot axis 12 and include a pair of hand grip means 41 provided on top thereof. Two pivot axles 42, 43 Are secured to the handle bars 40 and are located below and above the pivot axis respectively. A pair of links 50 includes one end pivotally coupled to the lower portion of the foot post 30 and includes a slot 53 and an opening 54 formed in the other end for coupling together of the pivot axles 42, 43. A stick 52 is secured to one of the links 50 for operating the links 50.

Figure 4:
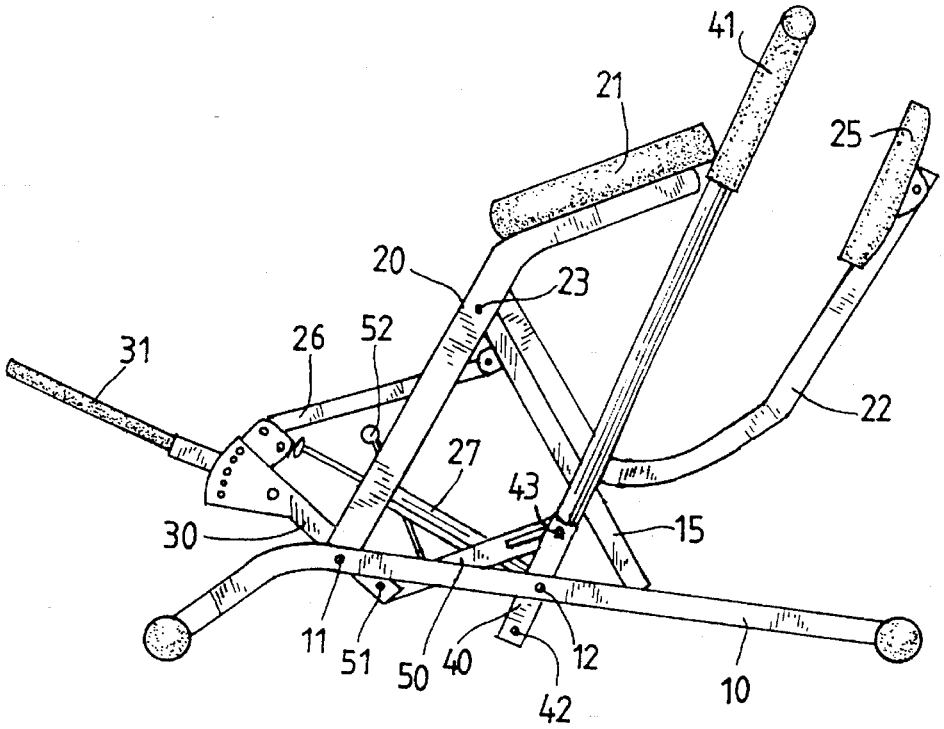
FIGS. 3 and 4 are plane views illustrating the operation of the horse-riding type exerciser in a pull type condition.
Figure 6:
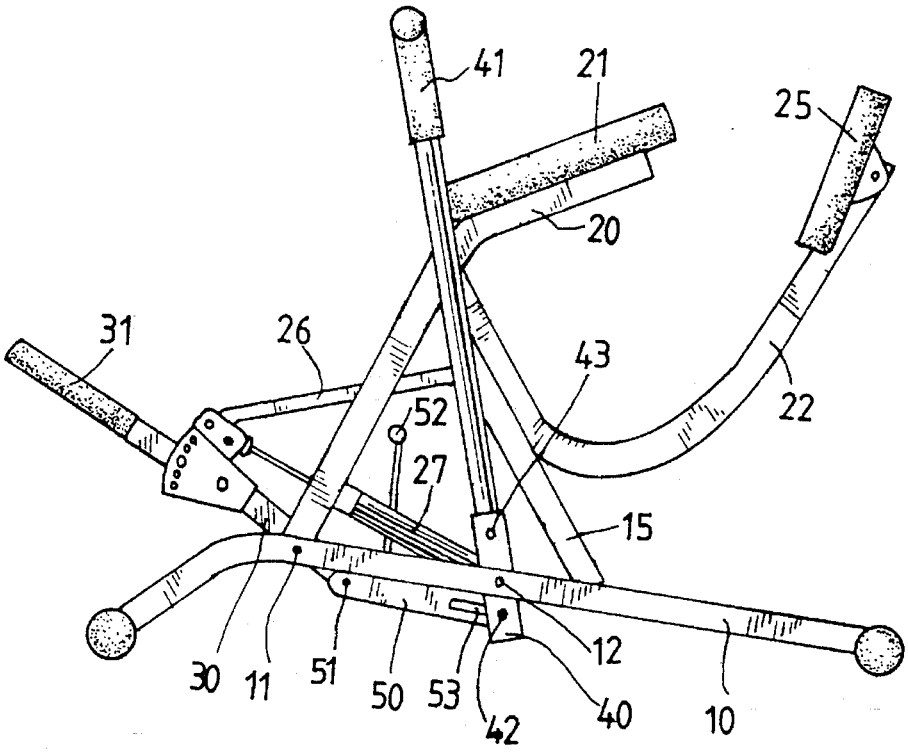
FIGS. 5 and 6 are plane views illustrating the operation of the horse-riding type exerciser in a push type condition.
Figure 5:
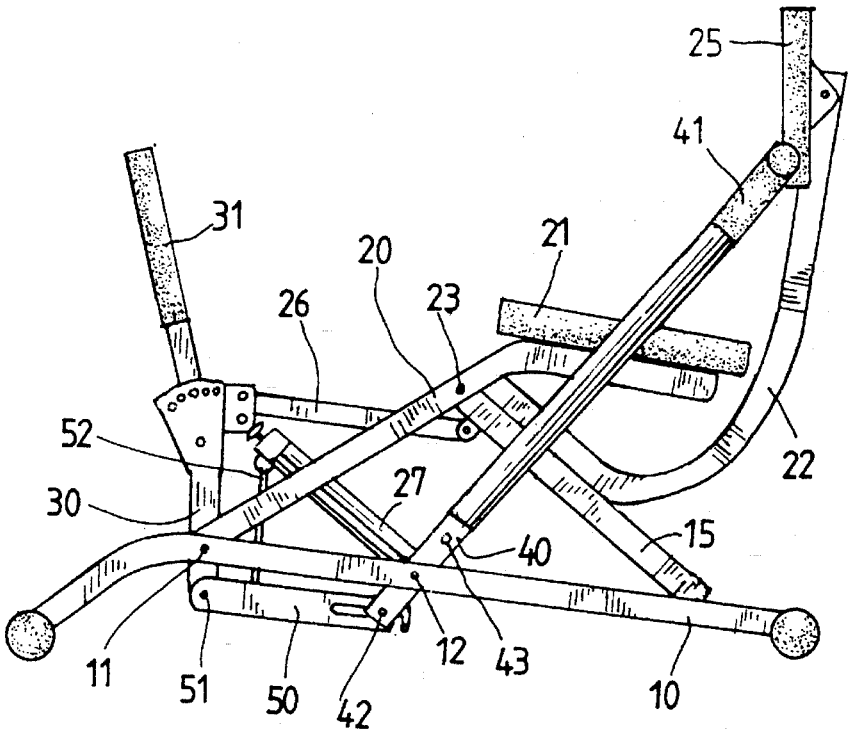

In operation, as shown in FIGS. 3 and 4, when the openings 54 of the links 50 are engaged with the upper pivot axle 43, the pole 15 may be pulled forward by the beam 26 when the foot post 30 is rotated by the link 50 such that the seat cushion 21 may be elevated when the hand grip 41 is pulled by the users and such that the users may conduct pull type horse riding type exercises. However, as shown in FIGS. 5 and 6, when the the link 50 is coupled to the pivot axle 42 which is located below the pivot axis 12, the seat cushion 21 may be elevated when the hand grip 41 is pushed forward by the users such that the users may conduct push type horse riding type exercises.

It is to be noted that the weight of the users may apply a force to the seat cushion 21, such that the users have to apply a force to the hand grips 41 and/or the foot pedal means 31 so as to elevate the seat cushion 21 and such that the exerciser may be used without the actuator 27. The link 50 may be easily engaged onto either of the pivot axles 42, 43 by the stick 52.

Accordingly, the horse-riding type exerciser in accordance with the present invention can be used for conducting both pull type and push type horse riding exercises and can be easily adjusted between the two types of exercises.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A horse riding type exerciser comprising: a base including a front portion having a pivot shaft provided therein, including a middle portion having a pivot axis provided therein, and including a rear portion having a track means provided therein, a seat post including a lower portion pivotally coupled to said base at said pivot shaft, including an upper portion having a seat cushion provided thereon, and including a middle portion, a pole means including a lower portion slidably engaged in said track means and including an upper portion pivotally coupled to said middle portion of said seat post, a foot post including a middle portion pivotally coupled to said pivot shaft and including an upper portion having a foot pedal means provided thereon, said foot post including a lower portion, a handle bar means including a middle portion pivotally coupled to said base at said pivot axis and including a hand grip means provided on top thereof, said handle bar means including at least one first pivot axle arranged above said pivot axis and including at least one second pivot axle arranged below said pivot axis, a beam pivotally coupled between said upper portion of said foot post and said pole means for moving said lower portion of said pole means along said track means when said foot post is rotated about said pivot shaft, and a link means including a first end pivotally coupled to said lower portion of said foot post and including a second end pivotally coupled to at least one of said first or second pivot axles, said seat cushion being elevated when said pole is moved toward said foot post by said beam and when said foot post is rotated by said handle bar means and when said second end of said link means is coupled to said first pivot axle and when said hand grip means is pulled toward said seat cushion; and said seat cushion being elevated when said second end of said link means is coupled to said second pivot axle and when said hand grip is pushed away from said seat cushion.

2. An exerciser according to claim 1 further comprising a stick means secured to said link means for operating said link means.

3. An exerciser according to claim 1, wherein said second end of said link means includes a notch means for engaging with said first and said second pivot axles.

4. An exerciser according to claim 1 further comprising an actuator means secured between said foot post and said pivot axis so as to apply a force against said foot post.

* * * * *